United States Patent [19]

Sorge et al.

[11] Patent Number: 4,983,077

[45] Date of Patent: Jan. 8, 1991

[54] METHOD AND AN APPARATUS FOR PRODUCING FABRIC-REINFORCED LINING SUPPORTS OR SLENDER SUPPORTING STRUCTURAL UNITS

[75] Inventors: Werner Sorge, Herne; Klaus Konieczny, Recklinghausen, both of Fed. Rep. of Germany

[73] Assignee: Gebhardt & Koenig-Gesteins- und Tiefbau GmbH, Recklinghausen, Fed. Rep. of Germany

[21] Appl. No.: 142,717

[22] Filed: Jan. 7, 1988

[30] Foreign Application Priority Data

Aug. 26, 1987 [DE] Fed. Rep. of Germany ..... 3728370

[51] Int. Cl.[5] ..... E21D 15/00

[52] U.S. Cl. ..... 405/288; 405/229; 405/303

[58] Field of Search ..... 405/288, 233, 230, 289, 405/150, 303

[56] References Cited

U.S. PATENT DOCUMENTS

| | | | |
|---|---|---|---|
| 1,752,101 | 3/1930 | Meutsch | 405/289 |
| 2,990,166 | 6/1961 | Walsh | 405/289 X |
| 3,345,824 | 10/1967 | Turzillo | 405/266 |
| 3,396,545 | 8/1968 | Lamberton | 405/233 |
| 3,492,823 | 2/1970 | Lamberton | 405/233 |
| 3,937,025 | 2/1976 | Alvarez-Calderon | 405/289 X |
| 3,984,989 | 10/1976 | Turzillo | 405/233 X |
| 4,102,138 | 7/1978 | Dreker et al. | 405/289 |
| 4,167,361 | 9/1979 | Petro et al. | 405/290 |
| 4,175,481 | 11/1979 | Burgess | 405/288 X |
| 4,185,940 | 1/1980 | Spies | 405/288 |
| 4,277,204 | 7/1981 | Koppers et al. | 405/288 |
| 4,332,512 | 6/1982 | Heintzmann et al. | 405/288 X |
| 4,459,064 | 7/1984 | Berset | 405/288 X |
| 4,465,405 | 8/1984 | Durrfeld | 405/288 X |
| 4,522,537 | 6/1985 | Kuck | 405/288 |
| 4,770,564 | 9/1988 | Dison | 405/288 |

FOREIGN PATENT DOCUMENTS

| | | | |
|---|---|---|---|
| 479871 | 5/1975 | U.S.S.R. . | |
| 2131850 | 6/1984 | United Kingdom | 405/150 |

OTHER PUBLICATIONS

"Steel Arches Taking Hold Underground", *Coal Age*, pp. 74–75 (1986).

"Donut Cribbing", Catalog M-12 (3MSR5/87), Commercial Shearing, Inc., P.O. Box 239, Youngstown, Ohio 44501 (1987).

"Investigations into Innovative Means of Secondary Gate Support", by S. Schaller and G. Savidis, *The Coal Journal*, pp. 45–54 (Mar. 1984).

*Primary Examiner*—Dennis L. Taylor

*Attorney, Agent, or Firm*—Kinney & Lange

[57] ABSTRACT

A method of producing structural supports for use particularly in mining applications includes the use of a relatively rigid and cylindrical shell casing. The shell casing is separable along the plane parallel to its axis, has open ends and is closed about a fabric tube which is axially supported therein. The fabric tube is filled with pressurized liquid building materials such as concrete. Once filled within the casing, the pressure of the building material forces the liquid component thereof out of the tube laterally and through perforations provided in the shell casing to drain the liquid away from the building material in the tube. The casing and tube are of size such that the remaining building material, which will constitute a pillar, extends completely between the surfaces it is to separate and support. Once the liquid has been drained from the building material within the fabric tube and shell casing, the shell casing can be removed even before the remaining building material is hardened into a pillar reinforced with an outer fabric tube. The shell casing can then be reused for producing additional fabric reinforced pillars.

22 Claims, 8 Drawing Sheets

METHOD AND AN APPARATUS FOR PRODUCING FABRIC-REINFORCED LINING SUPPORTS OR SLENDER SUPPORTING STRUCTURAL UNITS

BACKGROUND OF THE INVENTION

1. Field of the Invention

The present invention relates to a method for producing lining supports or elongated supporting structural units from a hardening building material and a reinforcement. These parts can be produced on the site by overgound and underground construction, the building material being liquid and brought together with the reinforcement only at the installation site. Lining supports produced using the invention are particularly suitable for mines and tunnel construction as an independent road lining or part of a road lining in which the lining supports act as props or prop pillars for the separately supported (anchored or lined) roof or the exposed rock. Inventive props and prop pillars differ from each other essentially by their slenderness ratio, that is, the ratio of diameter to length. In so far as the invention also relates to the production of elongated beams for overground and underground construction, these beams may be masts such as those used as lantern poles for strong sources of light, chiefly in street lighting. The inventive method may also be used to produce other beams, for example bulkheads.

The man field of application of the invention, however, is in drift mining, and in particular coal and ore mining. More precisely, the invention is useful for the road lining, where the inventive supports are used as a supporting lining in particular in a gate-end road whose roof may be secured by a temporary lining, for example anchored. The invention shall therefore be explained herein chiefly with reference to this field of application.

2. Description of the Prior Art In the main field of application of the invention referred to above, the inventive lining supports replace the pillars employed in particular in pillar-and-chamber work but also in longwall work and used as a supporting lining, and set in single or double rows. In so far as these pillars have been made of wood up to now, they are crosswise and horizontal layers of trimmed timbers. Wooden pillars of this kind are flexible to a certain extent due to their compressibility, which is advantageous in terms of lining technology for avoiding premature destruction of the lining by the rock pressure. While wood is usually, though not always, available and can be processed well, it is generally expensive. Further disadvantages in terms of wooden lining technology are the varying strengths of the timbers cooperating in a pillar, and the lack of lateral stability of the pillars depending on their slenderness ratio. The lack of resistance of wood to moisture and fire also occasionally causes considerable problems. The economy of such pillars is also diminished by the considerable expenses for the transport and processing of the wood and the high labor costs underground for erecting the pillars. By using a hardening building material and a reinforcement, the invention aims at lining supports which, due to their production on site in the drift, are easier to transport and cheaper to erect. In addition, the prop pillars of the present invention do not involve any problems of lateral stability due to their design, and are insensitive to moisture and fire.

Wooden pillars are the oldest known lining supports used in longwall work and pillar-and-chamber work, and there have already been proposals to replace them by pillars made of reinforced concrete. These are mainly concrete ties provided with reinforcing bars, which replace the trimmed timbers. A supporting lining consisting of such pillars involves the disadvantage that it is much heavier than a wooden lining, which considerably aggravates the transport problems and increases the labor costs, so that no advantages can be obtained beyond the possibility of replacing expensive and possibly unavailable wood by an available building material and eliminating the problems of fire resistance and insensitivity to moisture. In addition, however, the transport and erection of the described concrete tie pillars are complicated by the difficulty, based on the reinforcement, that the protruding reinforcing bars constitute a considerable danger of accident. On the one hand, they may cause dangerous injuries; on the other hand, they frequently crop up as unexpected obstacles.

In order to increase the necessary inner strength of the pillars and ease the problems of reinforcement, another known proposal suggests building cylindrical pillars of prefabricated cylindrical plates of steel fiber concrete. These pillars follow the principle of pillars made of concrete ties because the plates are stacked. The production of such prefabricated concrete parts already makes relatively high demands on the material due to the required strengths. Transport is expensive due to the high weight and often involves considerable danger of accident due to protruding steel fibers. The erection of the pillars must take place without setting pressure, so that an individually fitting wooden wedging must be provided between the upper end of the pillar and its contact surface. The labor expended is accordingly high. Nevertheless, the pillars are not always successfully set perpendicular to the stratification. This leads to uneven loads which may destroy this kind of pillar prematurely. The invention aims in particular at a lining support which avoids the dangers existing up to now.

Pull-out or telescoping props have also been proposed to replace wooden pillars. These props have telescopic parts made of relatively cheap material that are locked relative to one another after the prop is pulled out, and then filled with a hardening building material. Such a lining system with props or prop pillars avoids the problems of too little lateral stability of the pillar construction due to its consisting of one piece, but makes special demands on the material used as a filling; since the mixing water remains in the building material as it hardens, the production of such props must proceed relatively slowly. The expense for the telescopic prop part varies depending on the length and diameter of the prop pillar. Thus, of the main advantages of the pull-out prop system, namely the easier transport and low-quality material, are at least partly lost. Due to the lack of strength of cheap materials, the sturdy construction required for prop pillars is not possible.

On the other hand, the invention differs from a complete supporting lining produced underground of the form which supports at least the ends and the roof of a road, is made of fabric tubes extending in the transverse and longitudinal directions of the road but is filled with hardening building material progressively in the longitudinal direction of the road. In this arrangement, the pressure of the pumpable building material is used to obtain the shape and contact of the lining member in question against the rock from the initially slack tube as it is filled with the liquid building material, which presupposes that the proportion of water is retained in the tube. The fabric tube acts only as a shaping dead mold which, due to its waterproofness, greatly delays the hardening of the building material, thereby demanding considerable labor and time and in practice not leading to sufficient early strengths for the lining. It is virtually impossible to reinforce such a lining either, whereby the tube itself is useless after the building material has hardened. By contrast, the present invention aims at the production of a quickly supporting lining member whose load capacity is higher than that of the building material pillar.

Lining members of this kind, which develop high load capacity due to a composite construction, are already known in the form of the above-described pillar design with prefabricated reinforced concrete parts, but could not be produced from building materials in fabric tubes. However, fabric tubes filled with hardening building material are known as auxiliary elements in road lining which, when pumped up with the liquid building material, join the road lining to the surrounding rock by being braced between the segments of the road lining and the lagging and the rock. In this method the expandability of the folded fabric tube inserted into the support section is systematically exploited upwardly and to the side, the tube being provided with a corresponding oversize compared to the cavity in the support section, and stretched by the pumping to form an annular body of irregular cross-section which allows, along its length, for positive closure of the support section and the lagging or bumps in the rock with the tube. The load capacity of such a lining is ultimately based on the extremely expensive steel lining and therefore involves only a small proportion of cheaper materials. In particular, lining members cannot be obtained therefrom in the form of props or prop pillars for roads driven in the seam and longwall work. By contrast, the invention provides a road lining which is not based on any steel lining members but itself has the strength required for props and prop pillars.

SUMMARY OF THE INVENTION

According to the present invention, the basic method, which is suitable as such in particular for producing sturdy props or one-piece prop pillars, consists in stretching a fabric tube closed at both ends between the floor and lined or open roof, vertically or perpendicular to the stratification, and filling it with pressurized building material. The tube serves as a filtering medium which removes the water of the liquid building material to the outside and retains the drained solids of the building material in the form of a pillar. The tube also serves as a self-supporting lining reinforcement after the pillar of solids has hardened.

The inventive method involves the surprising effect that, due to the tube being filled from the bottom to the top and its straightness between the floor and roof, with a sufficiently sturdy form of the lining support as can be used for many props or prop pillars, the tube already has sufficient stability under load in composite construction with the drained but not yet hardened building material. This is due to the use of the tube fabric as a filter and the resulting rapid draining of the building material in all directions out of the shaped body. The building material therefore hardens extremely quickly but can be continuously pumped into the tube despite its draining before final hardening due to its being enclosed in the fabric tube. Thus, increasing stability under load comes about from the floor toward the roof in the shaped body as it is being formed. There is also the surprising effect that the tube fabric, when made of high-strength synthetic threads as obtained in particular with durpolasts, not only brings about the known draining effect but can also be regarded as a stable reinforcement of the hardening lining support. This outer reinforcement arises on the self-supporting length of the lining support and evidently holds together the building material for long periods of time in spite of high vertical loads on the building material pillar, so that the latter develops its full strength. Even if the shear strength of the building material is exceeded in the building material pillar, which becomes apparent due to cracks in the pillar behind the reinforcement, the cohesion of the pillar is ensured without any loss of load capacity. This is due in large extent to the fact that the tangential threads of the tube fabric have high tying stresses and the axial threads are biased by stretching and transmit forces because they are not bent or loaded against other lining members, as are the tubes acting as auxiliary elements in known road lining systems.

Lining supports produced by the new method replace not only the props used up to now, but also the pillars. This is most advantageous not only because the tubes (prefabricated in particular for the necessary average thickness) save space and can be transported easily, but also because production takes place in the drift with the aid of a building material pump which is fed the liquid building material from transport containers, if it is not mixed on the site. The building material itself can take any amount of mixing water and can therefore consist predominantly of solids which, like ashes from various sources such as electrofilter and fluid bed firing ashes, have low strength but develop high strengths in composite construction after the building material has hardened, so that they correspond to that of reinforced concrete. Furthermore, a reinforcement which may consist of reinforcing rods can be provided in the described production method before the building material is filled into the tube, thereby further increasing the strength. If a low slenderness ratio, that is a corresponding ratio of diameter to length, is ensured, the described method can also be used to produce overground construction beams on the site, which can be used as systematic or additional supports for ceilings or the like.

In the interests of obtaining optimal slenderness in such lining supports, but also to obtain predetermined, and in particular straight, supports or beam forms as generally required for the slender supporting structural units described, the inventive method is ordinarily carried out in such a way that the fabric tube is surrounded on most of its length by a perforated rigid shell casing in the shape of a tube. The necessary draining is performed through the perforations in the shell casing, and the shell casing is thereafter removed from the tube before the building material hardens.

In this embodiment of the inventive method, the shaping element for the support is the tubular shell which supports the fabric. The tubular shell acts with the tube, due to the shell's perforations, as a filter which withstands extremely high pump pressures, allowing for rapid draining in very short time periods and for the tubular shell to be removed almost immediately after the filling process. The fabric tube is not overloaded thereby and can thus serve as an effective outer reinforcement. The shell casing is reusable; although it only extends over a fraction of the free tube length, it can prevent radial extension and undesirable curvature of the tube in the longitudinal direction of the support when the building material is being pumped in, without impairing the axial extension of the fabric tube. This ensures the abutment of the support. The shrinkage of the building material filling due to draining also allows for axial movability of the tube in the shell. The described combination of shell and fabric tube is thus dimensionally stable in so far as it allows for pump pressures of up to 10 bar without any noticeable deviation from the predetermined shape.

The beams or lining supports produced by the inventive method can be produced in the drift but also in finished part factories. Since the outside diameter of the tube corresponds substantially to the inside diameter of the closed shell, these supports are as smooth as the shell on the outside along most of their length. They may be provided on the inside with a reinforcement, for example in the form of a cylindrical or conical wire basket which is fixed by spacers in the stretched tube before the filling is added. The outer reinforcement is chemically inert if synthetic threads are used for the tube fabric, and is thus nearly indestructible even when aggressive liquids are used, as met with in particular in mining and tunnel construction. On the other hand, if cheaper fabrics are used, for example jute threads, the necessary service life can be ensured by the type and composition of the building material selected. On the inside, the inventive support consists of the hardened building material. This may have a hydraulic component in the form of cement or a hydraulic gypsum, the selection depending largely on the cements or gypsums or additives available on the site, or on other points of view such as economy. The building material may contain sand and additives, depending on availability and expense. Instead of gravel, crushed rock and chippings, one may therefore also use the above-mentioned grainy ashes, in particular electrofilter and fluid bed ashes, for which no sufficient use could be found up to now but which bring about considerable and unprecedented strengths when processed in the inventive method.

The inventive method is also particularly rational, in particular when conducted in its preferred embodiment, because only a relatively short shell is then required. This is made possible by the fact that, even if extreme pump pressures are applied, the tube ends pressed out of one or both ends of the shell are neither deformed nor increased in their diameter to any great extent on a certain length, due to the inherent strength of the tube sufficing for short extension. The shell expenses can thus be reduced by using shorter shell lengths and by avoiding shells designed for any particular length, by determining the particular support length by the length of the tube.

In a further preferred embodiment of the inventive method, the shell (having a length corresponding to an average thickness) is set up and the tube in the shell made to abut, while being pumped up, with its upper end against the roof, its lower end being supported on the floor, and braced by the pressure of the filling. In this embodiment of the invention, the shell is independent of the local thickness in which a prop pillar is to be set. It can therefore be reused many times, in particular if extension pieces are used. The indefinitely long reusability is an essential condition for mechanizing the lining work because the shell can therefore be used in different roads and can be applied, for example, on the extension arms of a moving device which can also bear the other components of the prop pillar, in the form of a greater tube length, and the building material as well as the aggregates necessary for filling it, such as the pump and connecting pipes. The inventive method allows in this embodiment for the prop pillar to be set right up to the rock surface due to the tube ends emerging from the shell during pumping. If no sufficient setting pressure is obtained thereby, simple wedging can be used. This replaces manual wedging and thus saves most of this labor.

Further, the invention allows for the support to be set up and braced in pressure-flexible fashion using a pressure-flexible material in the form of one or more plates on at least one end of the tube. This replaces any wedging and allows for a degree of flexibility under pressure which can be selected virtually precisely by the dimensions of the plate or plates and the selection of their material, after the exhaustion of which the prop pillar is rigid until its elastic deformability is exceeded.

In particular, the plates can be used in the inventive method for removing water from the tube filling if a plate material is used which reacts with the removed water. This allows for even faster draining, in particular at the ends of the tube. In plates formed out of a so-called single-component polyurethane foam, the foaming components, which form a prepolymer consisting, for example, of a polyol and a polyisocyanate, react with the surrounding moisture. The foam when completely hardening thus withdraws moisture from the building material in the tube through the tube fabric, and in turn the mixing water, so that the tube ends first loaded harden faster.

If such plates or wooden plates are used, it is expedient to support the plates on the upper closed end of the tube on needles which are stuck into the fabric and radially penetrate the tube. The tube is then filled axially and under the plates fixed by the needles on the tube end. The needles are withdrawn and thereby removed before the building material hardens. The needles preferably consist of lengths of sufficiently strong wire.

In another embodiment of the invention, the tube filling is left out at one or more places and a cavity accessible from the outside is created in the finished pillar. Such embodiments involve the advantage, in mining and tunnel construction for example, that the prop pillars can be robbed or destroyed. A hole can be drilled in the cavity and an explosive charge provided therein which upon explosion causes the prop pillar to buckle. The prop cavity may also be longer and is then given a hollow support with a larger diameter but increased strength. This increases security against buckling.

It normally suffices to cut off the particular tube length required from a reel or a stack and tie it up at both ends, thereby creating a ball of fabric at each end. In order to avoid disturbances due to this accumulation of tube fabric, a cavity can be left according to the invention in the middle of one or both plate for taking up the ball of fabric. The ball of fabric is thus sunk below the even surface of the plate in question as soon as the setting pressure takes effect. This results in improved contact with the rock, particularly on the upper end of a prop pillar which has an enlarged flat surface.

BRIEF DESCRIPTION OF THE DRAWINGS

The details of the inventive method and an apparatus for realizing it shall be explained in the following by way of example with reference to the figures in the drawing, in which.

DETAILED DESCRIPTION OF THE PREFERRED EMBODIMENTS

Figure 1:
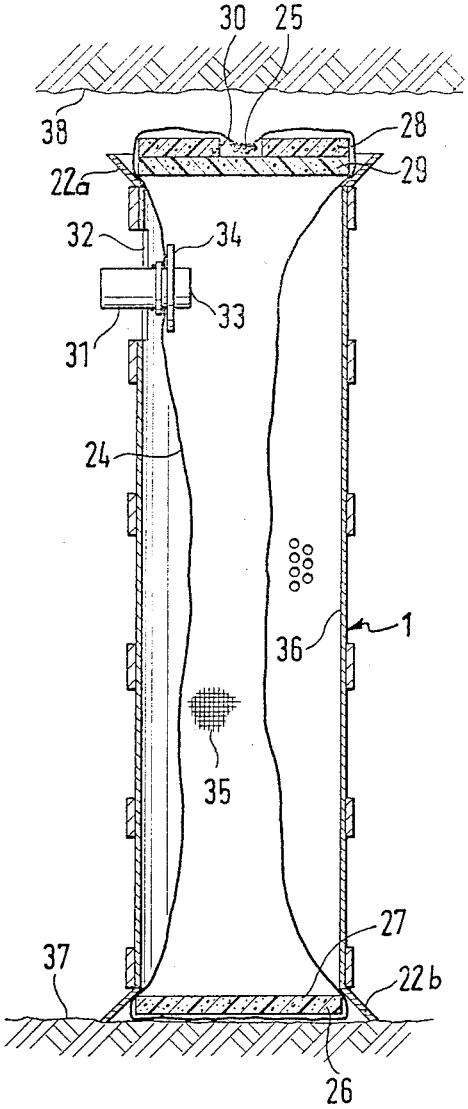
FIG. 1 shows schematically, i.e., omitting all details not required for understanding the invention, a longitudinal cross-section of an inventive prop pillar before the building material is inserted.
Figure 2:
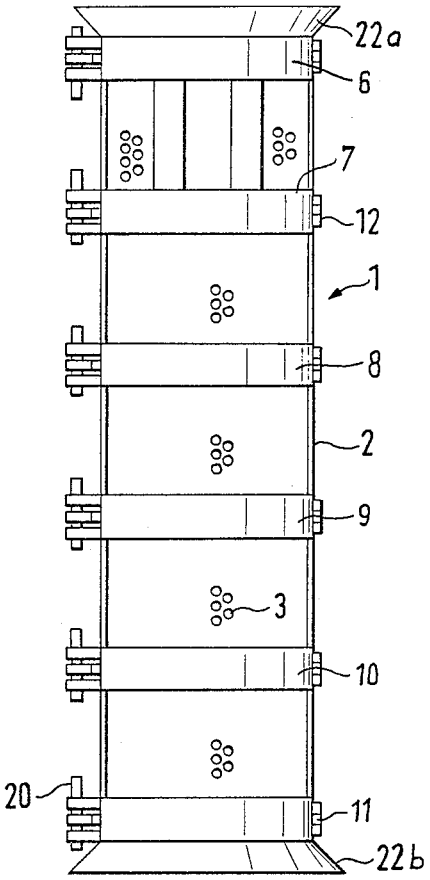
FIG. 2 shows a side view of an inventive shell casing in the closed state.

FIGS. 1 and 2 show a rigid shell casing 1 with a bipartite design, The shell casing 1 consists of a cylindrical sheet 2 with closely adjacent relatively small perforations 3. The sheet 2 is divided on the longitudinal center plane of the cylinder, thereby creating two half shells 4, 5 (FIG. 4). Divided band clamps 6 to 11 are provided at their adjacent ends with hinges 12 which hinge together their two halves 14, 15. Band clamp half 15 bears at its free end a fork 16 engaged by tongue 17 attached to the free end of other band clamp half 14. Parts 16 and 17 have oblong openings 18, 19 for receiving a locking wedge 20, which can be driven from the top to the bottom into the openings in alignment when the band clamps are closed, as shown at 19 in FIG. 3. Free edges 21*a*, 21*b* of shells 4, 5 are thus supported on each other and braced.

Band clamps 6 and 11 attached to the ends of shell casing 1 each bear a conical sheet portion 22*a*, 22*b* protruding upwardly and downwardly therefrom, respectively.

The inside diameter D (cf. FIG. 3) of shell casing 1 corresponds substantially to the outside diameter of a fabric tube 24 which is cut off a roll or package to a length exceeding the length or height of shell casing 1. Before fabric tube 24 is tied off, a plate 26 made of a flexible material, for example polyurethane foam 27, in inserted into the lower end of the tube 24, as seen in FIG. 1. Plates 28, 29 are also inserted into the upper end of the tube 24 before fabric tube 24 is tied. The outer plate, plate 28, has a recess 30 into which ball of fabric 25 resulting from the tying is inserted.

The fabric tube 24 has a filler neck 31 which is directed to the outside through an opening 32 in one of half shells 4, 5. In the embodiment shown, the filler neck 31 has a check valve 33 consisting of an invisible flexible disk housed in flange 34 and capable of turning inside out as soon as it is loaded from the outside, but lying against a supporting cross as soon as it is pressed outwards by a larger internal pressure.

Conical sheet-metal rings 22*a*, 22*b* ensure that fabric 35 of tube 24 is considerably greater than the height of rigid shell casing 1.

After the fabric tube 24, tied off over its plates 26 to 29, has been inserted into shell casing 1 and the shell casing closed and braced by driving in its wedges 20, liquid building material is pumped into tube 24 through neck 31 via a connecting tube (not shown). The tube 24 thereby comes to lie against inside 36 of the shell casing 1 but is then prevented from expanding further radially. The length of tube 24 beyond the height of shell casing 1 causes the tube ends to emerge from conical sheet-metal rings 22*a*, 22*b* so that they lie against rock surfaces 37, 38 formed by the floor and roof of a seam in which a road is driven. As soon as the tube ends have achieved their contact, the increase in pump pressure causes the mixing water of the liquid building material to be removed to the outside through fabric 35 and perforations 3 in shell casing 1. At the same time the tube ends are braced with rock surfaces 37, 38, which leads to compression of plates 26 to 29. The mixing water emerging from perforations 3 in shell casing 1 is clear. By this arrangement, the contents of the tube 24 are, for the most part, completely drained. The resulting building material and tube combination already possesses sufficient stability under load before hardening of its grout consisting of cement or gypsum or another hardenable building material. Accordingly, wedges 20 can be detached and the shell casing 1 opened and removed in the way apparent from FIG. 4. After hardening, the tube 24 (with its fabric 35) constitutes a reinforcement for the prop pillar made of the building material. Shell casing 1 can be used elsewhere in the meantime to erect another prop pillar of the described kind.

Figure 5:
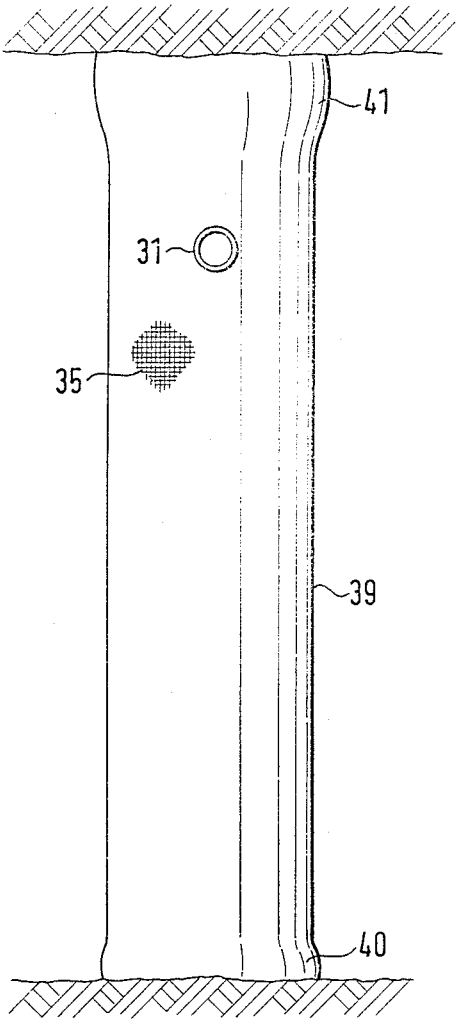
FIG. 5 shows a side view of the finished inventive prop pillar after removal of the shell.

Prop pillar 39, which is finished after removal of the shell casing 1 and hardening, has a fully cylindrical design on the length of shell casing 1 in accordance with the embodiment shown in FIG. 5. Tube ends 40, 41 emerging downwardly and upwardly, respectively, from shell casing 1 bulge radially outwardly but have only a slightly larger outside diameter than the center cylindrical portions of the prop pillar 39. Due to its low value, neck 31 remains on tube fabric 35 serving as a reinforcement, but may also be removed, for example to recover the check valve.

Figure 3:
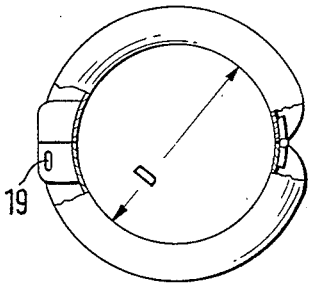
FIG. 3 shows a top view of the object of FIG. 2 in a closed state, with some parts broken away and shown in section.
Figure 4:
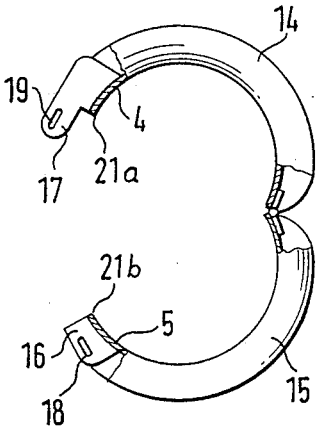
FIG. 4 shows the object of FIGS. 2 and 3 in the open state in a view corresponding to FIG. 3.
Figure 6:
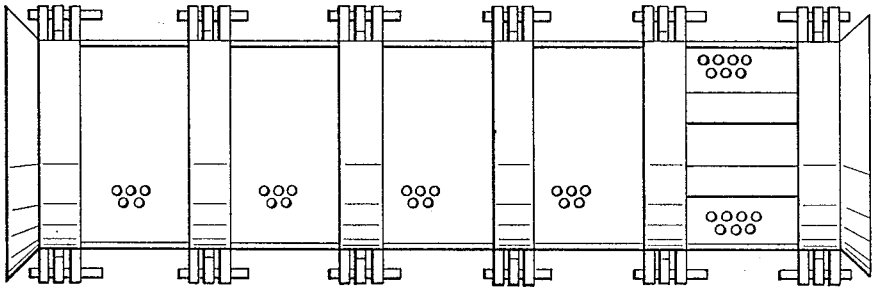
FIG. 6 shows a modified embodiment of the shell casing in a view corresponding to FIG. 2.
Figure 7:
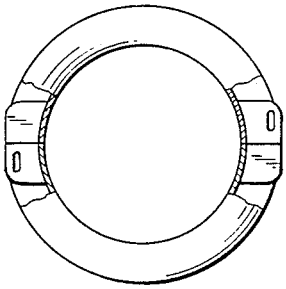
FIG. 7 shows the object of FIG. 6 in a view corresponding to FIG. 3.
Figure 8:
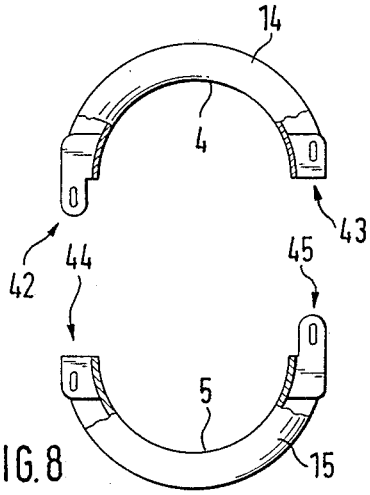
FIG. 8 shows the object of FIGS. 6 and 7 in a view corresponding to FIG. 4.

In the embodiment of FIGS. 6 to 8, the two half shells 4, 5 are completely separable from each other, since the closures of the embodiment of FIGS. 2, 3, and 4, shown at 16 to 20 (FIG. 4), are provided at both ends of band clamp halves 14, 15, as indicated by the arrows at 42, 43, 44 and 45 (FIG. 8).

Figure 9:
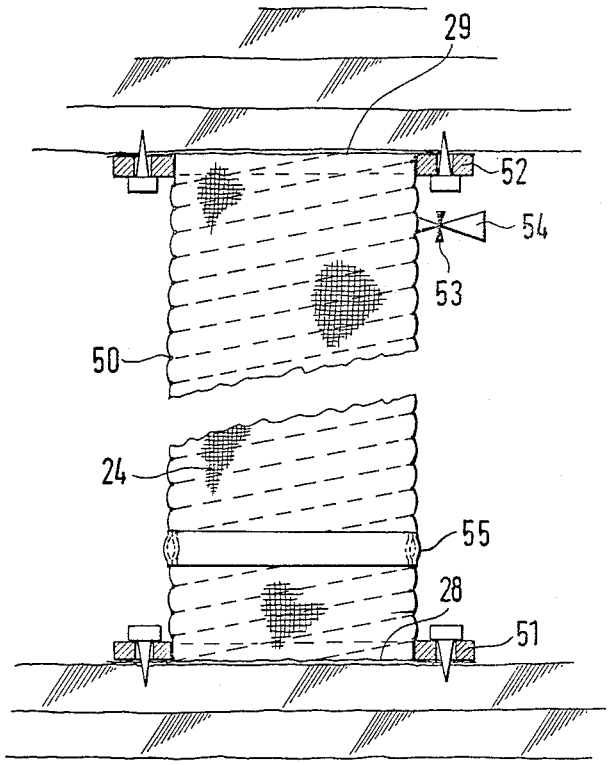
FIG. 9 shows a modified embodiment of the invention in a view corresponding to FIG. 5, with some parts broken and shown in section.
Figure 10:
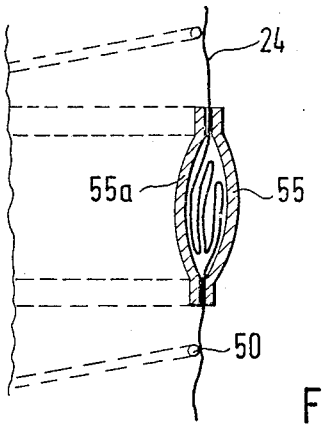
FIG. 10 shows a detail of FIG. 9.

In another embodiment, a prop pillar is formed without a shell casing. According to FIGS. 9 and 10, the fabric tube 24 is closed at both ends by prefabricated bottoms and above-described plates 28, 29, so that it is leakproof at the ends even at high pressures. Since the building material, with its extremely short hardening time, exerts considerable pressure on the tube, the tube is formed from not only the highly resistant synthetic threads of the described kind, but also of a reinforcement 50 which, as shown in FIGS. 9 and 10, has a helical shape in order to ensure a fit to different rock openings, and in particular seam thicknesses. An inner reinforcement in addition to this outer reinforcement is not shown in the Figures. The plates at the particular ends are connected in the embodiment of FIGS. 9 and 10 with rings 51, 52 which are attached to the rock via bolts or cramps by means of a spring lock means. In this way the tube 24 additionally provides a relatively stable and dimensionally rigid shell which ensures the shape of the prop pillar shown. The fabric tube 24 is filled under pressure via filler neck 54.

If prop pillars of progressive sizes are to be produced, this can be achieved with a variability of length which allows for a fit to different rock openings or seam thicknesses. The possibility shown in FIGS. 9 and 10 involves two concentric metal rings 55 and **55*a* between which the tube fabric 35** is folded in several layers in the manner of an accordian, and clamped. In the case of axial tensile strains, the fabric of the tube may be pulled out of the magazine thus formed. The clamping effect is selected such that the folded fabric of the tube cannot slip out of the two rings clamped together under the internal pressure occurring during filling.

Figure 13:
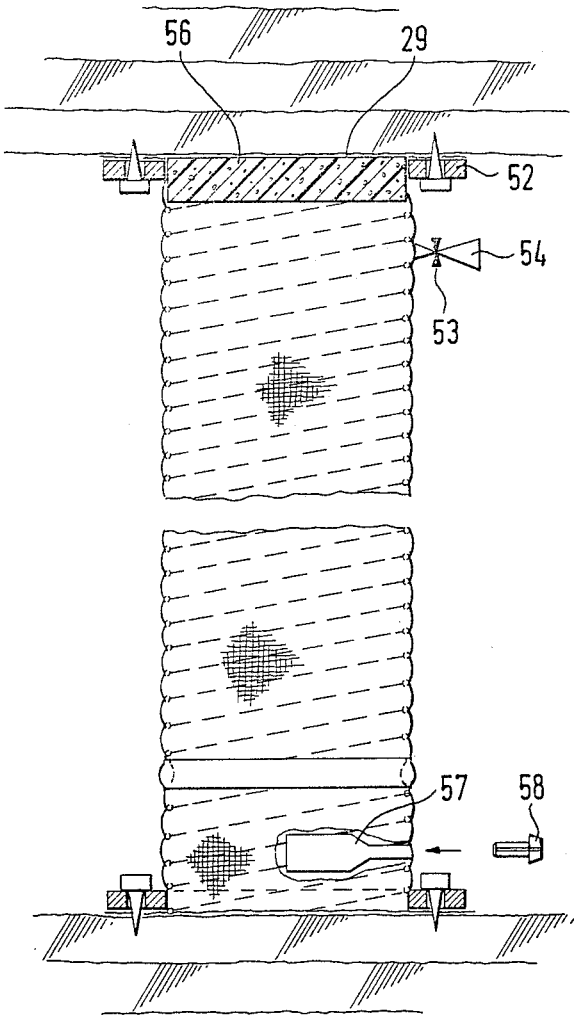
FIG. 13 shows a further modified embodiment of the invention in a view corresponding to FIGS. 5 and 9, with some parts broken and shown in section.

A very sturdy support as used in particular as a prop pillar is shown in FIG. 13. For particularly difficult rock conditions, the prop pillar is equipped with a flexibility which is ensured in the embodiment by a plate 29 made of hard foam 56 disposed on the roof. The thickness of the plate determines the flexibility. Hard polyurethane foams have a low specific weight so that such plates are easy to transport.

In the embodiment of FIG. 13, a robbing means (pillar destruction means) is also installed in the prop pillar. This is provided by a chamber 57 left open in the filling into which a torpedo (explosive) is inserted before robbing. In this embodiment the chamber can also be designed in such a way, however, that hydraulic pressure applied from the outside via a connection 58 presses or forces the prop pillar apart. A plastic bubble inserted into the fabric tube before filling can be used as the shaping element for chamber 57.

Figure 11:
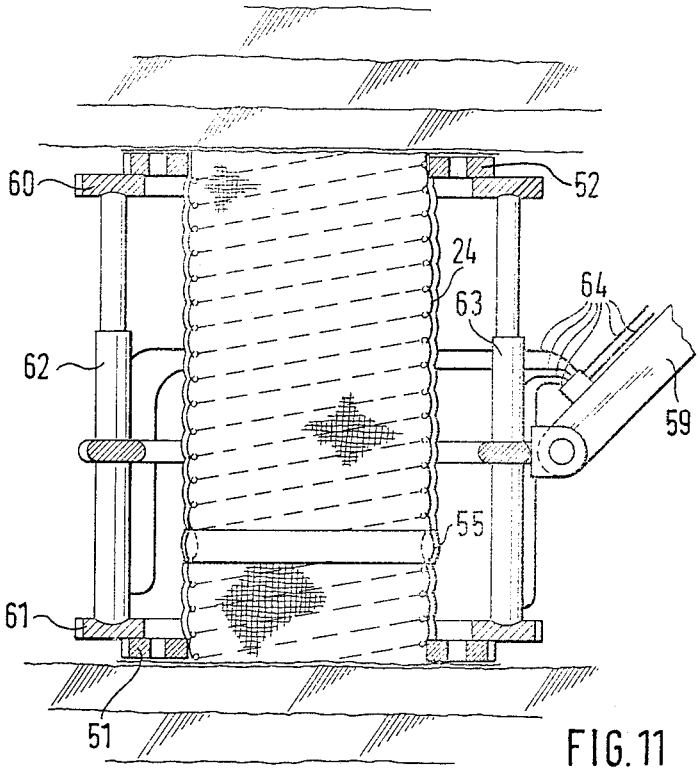
FIG. 11 shows a further modified embodiment of the invention in a view corresponding to FIG. 1.
Figure 12:
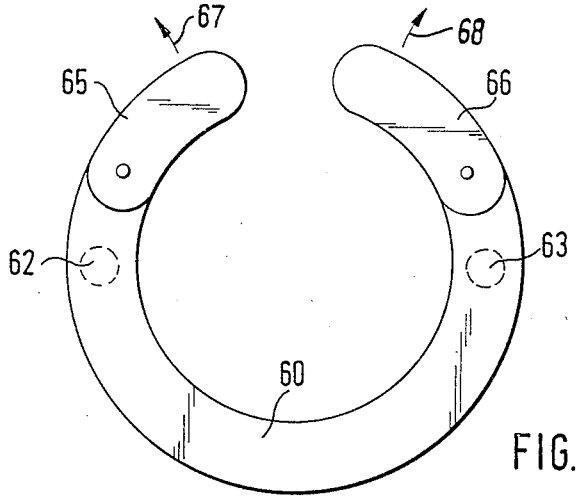
FIG. 12 shows a top view of the apparatus used in the embodiment of FIG. 11.

FIGS. 11 and 12 show an apparatus which allows for partial or full mechanization of the production of a prop pillar. On a moving device (not shown) which is mounted rotatably and sluably on a small mobile vehicle, a superstructure with an extension arm 59 is provided. Located thereon is a spatially pivoted support system consisting of two rings 60, 61 and two props (e.g., hydraulic actuators) 62, 63. The fabric tube 24 with its connecting rings 51, 52 is inserted into the support system in such a way that rings 51, 52 come to lie against the roof and floor when props 62, 63 are moved out (expanded). The props 62, 63 are subjected to pressure via hydraulic tubes 64 from the control stand of the vehicle. After the relatively short hardening time, which preferably lasts only a few minutes, swing-out parts 65, 66 (see FIG. 12) of rings 60, 61 are opened up on the roof and bottom (in direction of arrows 67, 68, respectively), so that the supporting means can be removed from the set pillar which is stable after draining. The containers disposed on the vehicle for the building material, any additives and the mixing water, as well as the pump for supplying the building material to the fabric tube under pressure as described, are not shown.

Figure 14:
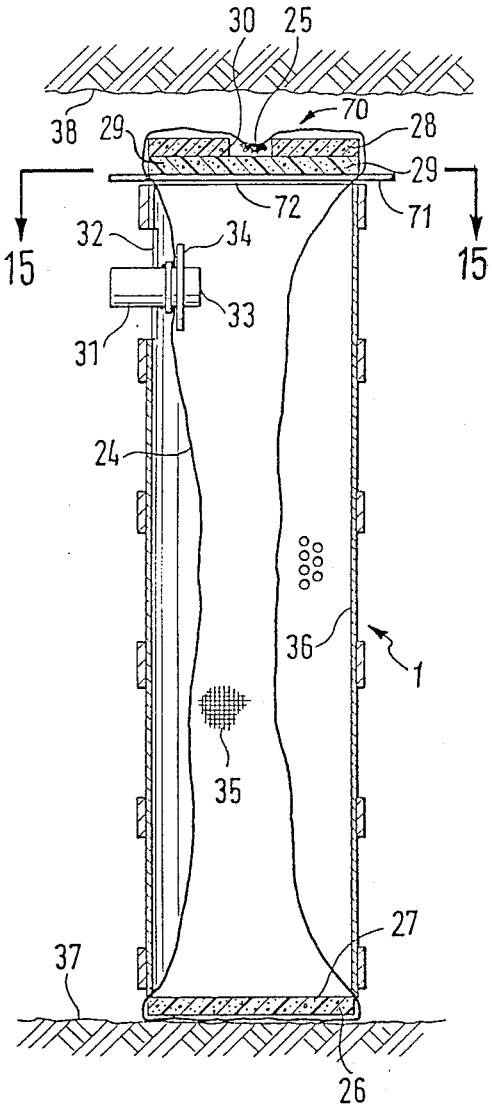
FIG. 14 shows a further embodiment of the present invention, in a view corresponding to FIG. 1.
Figure 15:
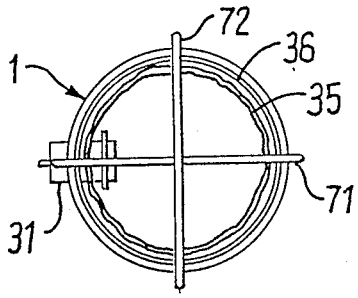
FIG. 15 shows a lateral view of the embodiment of FIG. 14, as taken along lines 15—15.

In the embodiment seen in FIG. 1, the plates 26, 28 and 29 are larger in diameter than the shell casing 1. Thus, upper plates 28 and 29 rest on conical sheet portion **22*a* before and during the tube filling process. In another embodiment, seen in FIGS. 14 and 15, the plates 28 and 29 are smaller and needle means are provided to support the plates above the shell casing 1. At an upper closed end 70 of fabric tube 24, the plates 28 and 29 are supported on needles 71, 72, which are stuck into the fabric 35 and radially penetrate the tube 24. After the liquid building material is deposited into the fabric tube 24, the needles 71, 72 are withdrawn (before the building material hardens). Preferably, the needles 71, 72** are formed from lengths of sufficiently strong wire.

Figure 16:
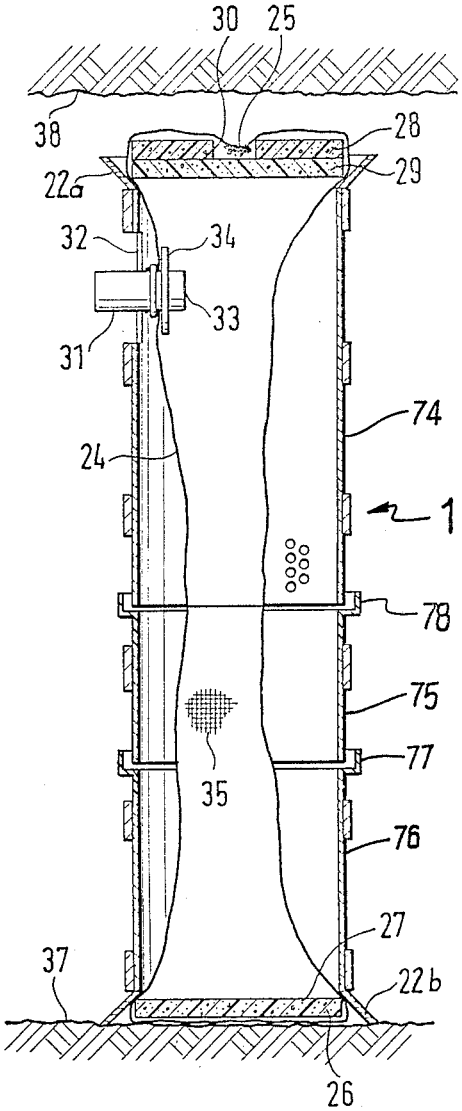
FIG. 16 shows a further embodiment of the present invention, in a view corresponding to FIG. 1.

In another embodiment of the present invention, the shell casing 1 is adapted to receive one or more extension pieces and thereby permit longitudinal extension of the shell casing. As seen in FIG. 16, the shell casing 1 is formed from a plurality of casing sections 74, 75 and 76. An upper casing portion 74 has the conical sheet portion **22*a* at an upper end thereof, and a lower casing portion 76 has the conical sheet portion 22*b* at a lower end thereof. The casing portions 74 and 76 are adapted to receive one or more casing extensions section 75 therebetween. Lower casing portion 76 has hook means 77 at an upper lend thereof for receiving and engaging a lower lend of the casing extension section 75, and the casing extension section 75 in turn has hook means 78 at an upper end thereof for receiving and engaging a lower end of the upper casing portion 75. Additional casing extension sections 75 can be inserted to form a shell casing 1** of desired length.

Although the present invention has been described with reference to preferred embodiments, workers skilled in the art will recognize that changes may be made in form and detail without departing from the spirit and scope of the invention.

What is claimed is:

1. A method for producing a fabric-reinforced support, in particular in mines and tunnel construction, consisting of a hardening building material and a reinforcement comprising the steps of:

stretching a fabric tube which is closed at both ends generally vertically between a floor and roof of an underground chamber;

surrounding a portion of the fabric tube between its ends with a generally cylindrical and perforated rigid shell casing which leaves at least one end portion of the fabric tube unsurrounded;

filling the fabric tube with pressurized liquid building material until the ends of the filled tube abut the floor and the roof and until the unsurrounded end portion of the fabric tube bulges radially outwardly beyond the circumference of the cylindrical shell casing adjacent its respective floor or roof;

filtering the liquid building material through the fabric tube which removes the water of the liquid building material to the outside of the fabric tube and retains the drained solids of the liquid building material on the inside of the fabric tube in the form of a pillar that quickly hardens from bottom to top, with the fabric tube serving as a self-supporting outer reinforcement for the hardened pillar;

draining the water removed from the fabric tube through the perforations in the shell casing; and removing the shell casing from about the fabric tube before the building material completely hardens.

2. The method of claim 1, and further comprising the step of:

bracing the pillar in pressure-flexible fashion using a pressure-flexible material in the form of one or more plates on at least one end of the fabric tube.

3. The method of claim 2, and further comprising the step of:

removing water from the liquid building material by providing a plate of material which reacts with the removed water.

4. An apparatus for use in producing a prop pillar from a fabric tube filled with liquid building material and positioned generally vertically on end between opposed floor and roof surfaces of an underground chamber, characterized by closed ends on the fabric tube and a rigid tubular shell for encasing the tube along a portion of the length of the tube, the shell having an inside diameter corresponding to the outside dimensions and shape of the fabric tube and having open ends, and the shell being perforated, divided into a plurality of shell portions along a tubular axis thereof, and provided with detachable closures to facilitate the removal of the shell from the tube and with the axial length o the shell being shorter than the axial length of the fabric tube when the tube, is filled with building material under pressure so that the closed ends of the tube are expanded axially to abut their respective floor and roof surfaces, that portion of the tube within the shell casing is expanded radially to abut the inside of the shell casing and that portion of the length of the tube that is not encased by the shell casing is expanded radially beyond the diameter of the shell casing.

5. The apparatus of claim 4, characterized in that the open ends of the shell have outwardly pointing flares.

6. The apparatus of claim 4, characterized in that a tubular shell extension piece is attached to the tubular shell to extend the tubular shell axially.

7. The apparatus of claim 4, characterized in that the tubular shell is mounted and selectively supported by at least one telescopic extension arm.

8. The apparatus of claim 4, characterized in that a liquid building material filler neck for the fabric tube is directed from the inside of the fabric tube to the outside thereof through the shell.

9. The apparatus of claim 4, characterized in that at least one plate made of pressure-flexible material is inserted into the fabric tube and supported on the inside thereof adjacent one of the ends of the tube.

10. The method of claim 1, and further comprising the step of:

leaving a cavity in the building material in the tube as it forms a pillar, with the cavity being accessible from outside the hardened pillar once the shell casing has been removed.

11. The method of claim 2, and further comprising the steps of:

gathering together portions of the fabric tube proximate at least one of its ends to close off that end of the fabric tube; and housing the gathered fabric in a cavity in at least one of the plates.

12. A method for producing a fabric-reinforced support, in particular in mines and tunnel construction, consisting of a hardening building material and a reinforcement comprising the steps of;

stretching a fabric tube closed at both ends generally vertically between a floor and roof of an underground chamber;

surrounding a portion of the fabric tube between its ends with a perforated rigid shell casing;

positioning at least one plate within the fabric tube adjacent a closed upper end thereof;

inserting a plurality of needles radially through the fabric tube for supporting the plate on an upper end of the shell casing;

filling the fabric tube with pressurized liquid building material;

filtering the liquid building material through the fabric tube which removes the water of the liquid building material to the outside of the fabric tube and retains the drained solids of the liquid building material on the inside of the fabric tube in the form of a pillar that quickly hardens from bottom to top, with the fabric tube serving as a self-supporting outer reinforcement for the hardened pillar;

draining water from the liquid building material removed from the fabric tube through perforations in the shell casing;

removing the shell casing from about the fabric tube before the building material hardens.

13. The method of claim 12, and further comprising the step of:

withdrawing the needles from the fabric tube after filling but before the building material hardens.

14. The apparatus of claim 4, and further comprising:

means for forming a cavity in the building material in the tube, with the cavity being accessible from outside the prop pillar once the shell is removed from the tube.

15. The apparatus of claim 4, and further comprising:

at least one plate within the fabric tube adjacent a closed upper end and thereof, and means for supporting the plate on an upper end of the shell.

16. The apparatus of claim 15 wherein the supporting means is a plurality of needles extending through the tube.

17. A partially completed underground prop pillar assembly comprises:

a fabric tube which is closed at both ends;

a generally cylindrical and perforated rigid shell casing surrounding a first portion of the fabric tube between its closed ends, the shell casing having open ends and extending generally vertically between opposed floor and roof surfaces of an underground chamber, and having at least one end of the shell casing spaced from its respective floor or roof surface so that a second portion of the fabric tube is unsurrounded by the shell casing; and a mass of pressurized liquid building material which has been introduced into the fabric tube to fill the tube so that the surrounded first portion thereof expands radially to abut the shell casing, the closed ends thereof expand longitudinally to abut the opposed surfaces of the floor and roof and the unsurrounded second portion of the fabric tube bulges radially outwardly beyond the circumference of the shell casing, which thereby defines a prop pillar which, upon hardening of the building material and removal of the shell casing, is self-supporting and reinforced by the fabric tube.

18. The assembly of claim 17, and further comprising:

means for forming a cavity in the building material in the tube, with the cavity being accessible from outside the prop pillar once the shell casing has been removed from about the tube.

19. The apparatus of claim 17, and further comprising:

at least one plate within the fabric tube adjacent a closed upper end thereof; and means for supporting the plate on an upper end of the shell.

20. The apparatus of claim 19 wherein the supporting means is a plurality of needles extending through the tube.

21. The apparatus of claim 17 wherein the shell casing has a fill hole therethrough and further comprising:

a filler neck extending through the hole in the shell casing and into the fabric tube for use in introducing liquid building material into the tube.

22. The apparatus of claim 17 wherein and further comprising:

outwardly pointing flare sections at the ends of he shell casing.

* * * * *

UNITED STATES PATENT AND TRADEMARK OFFICE

CERTIFICATE OF CORRECTION

PATENT NO. : 4,983,077

DATED : January 8, 1991

INVENTOR(S) : Werner Sorge et al.

It is certified that error appears in the above-identified patent and that said Letters Patent is hereby corrected as shown below:

Col. 11, line 29, delete "o", insert --of--.

Col. 14, line 11, delete "he", insert --the--.

Signed and Sealed this

Eleventh Day of August, 1992

*Attest:*

DOUGLAS B. COMER

*Attesting Officer*

*Acting Commissioner of Patents and Trademarks*